United States Patent [19]

Schafer et al.

[11] Patent Number: 4,808,239

[45] **Date of Patent: * Feb. 28, 1989**

[54] METHOD OF CLEANING CONTACT LENS USING COMPOSITIONS CONTAINING POLYETHER CARBOXYLIC ACID SURFACTANT

[75] Inventors: Doris Schafer; Rolf Schafer, both of Arisdorf, Switzerland

[73] Assignee: Alcon Laboratories, Inc., Forth Worth, Tex.

[ * ] Notice: The portion of the term of this patent subsequent to Jul. 8, 2003 has been disclaimed.

[21] Appl. No.: 53,982

[22] Filed: May 22, 1987

Related U.S. Application Data

[63] Continuation-in-part of Ser. No. 882,671 Jul. 7, 1986, abandoned, which is a continuation of Ser. No. 687,274, Dec. 28, 1984, Pat. No. 4,599,195.

[51] Int. Cl.[4] ..... B08B 7/00; C11D 1/08

[52] U.S. Cl. ..... 134/42; 252/89.1; 252/173; 252/174.21; 252/DIG. 14

[58] Field of Search ..... 252/89.1, DIG. 14, 173, 252/174.21; 134/42

[56] References Cited

U.S. PATENT DOCUMENTS

| | | | |
|---|---|---|---|
| 3,038,862 | 6/1962 | de Jong | 252/545 |
| 3,882,036 | 5/1975 | Krezanoski et al. | 252/106 |
| 4,152,283 | 5/1979 | Cordrey et al. | 252/99 |
| 4,285,738 | 8/1981 | Ogata | 134/26 |
| 4,356,100 | 10/1982 | Sherman | 252/106 |
| 4,410,442 | 10/1983 | Lucas et al. | 252/107 |
| 4,440,662 | 4/1984 | Tsuzuki et al. | 252/106 |
| 4,500,441 | 2/1985 | Tanaka et al. | 252/89.1 |
| 4,599,195 | 7/1986 | Schafer et al. | 252/546 |
| 4,609,493 | 9/1986 | Schafer | 252/546 |

FOREIGN PATENT DOCUMENTS

| | | |
|---|---|---|
| 0102118 | 3/1984 | European Pat. Off. . |
| 3320340 | 12/1983 | Fed. Rep. of Germany . |
| 37908 | 4/1974 | Japan . |
| 38506 | 3/1977 | Japan . |
| 8604083 | 7/1986 | World Int. Prop. O. . |
| 8604084 | 7/1986 | World Int. Prop. O. . |

*Primary Examiner*—Prince E. Willis

*Attorney, Agent, or Firm*—James A. Arno; Gregg C. Brown

[57] ABSTRACT

Nontoxic, aqueous, contact lens cleaning compositions containing a weakly anionic surfactant, and optionally also a chelating agent, urea and/or a source of hydrated protons, and methods of chemically removing protein, lipid and calcium deposits from contact lens utilizing these compositions are described.

2 Claims, No Drawings

METHOD OF CLEANING CONTACT LENS USING COMPOSITIONS CONTAINING POLYETHER CARBOXYLIC ACID SURFACTANT

CROSS REFERENCE TO RELATED APPLICATION

This application is a continuation in part of U.S. patent application Ser. No. 882,671, filed July 7, 1986 and now abandoned, which is a continuation of Ser. No. 687,274, filed Dec. 28, 1984, and now U.S. Pat. No. 4,599,195.

BACKGROUND OF THE INVENTION

1. Field of the Invention

The present invention relates to the removal of deposits from contact lenses, particularly soft contact lenses. More specifically, the present invention relates to aqueous contact lens cleaning compositions and to methods for removing protein, lipid, and calcium deposits from contact lenses using these compositions.

2. Description of the Prior Art

The compositions and methods of the present invention are especially useful in removing deposits from soft contact lenses. The "soft" lenses referred to herein are generally those lenses formed from a soft and flexible material. Although the present invention is not directed toward the manufacture of soft contact lenses, it should be noted as general background for this invention that various materials and methods for producing soft contact lenses have been described in the art. For example, U.S. Pat. Nos. 3,503,393 and 2,976,576 describe the use of various polymeric hydrogels based on acrylic esters in the manufacture of soft contact lenses. It is also known in the art that soft contact lenses may be based on silicone and other optically suitable flexible polymers. The general physical characteristics of soft contact lenses are due at least in part to the fact that these lenses absorb a high percentage of water. Due to this hydration, the polymer swells to form a soft and flexible material, thereby resulting in a physically stable material capable of maintaining its shape and dimensions.

One of the major problems associated with the use of soft contact lenses is the formation of deposits when these lenses are worn on the human eye. The composition of these deposits is complicated and varies from patient to patient; however, the deposits are believed to primarily consist of proteins, lipids and calcium. The deposits may form both on the lens surface and beneath the lens surface. The buildup of material on and below the surface of the lens creates discomfort and irritation in the eye of the patient.

The material attached at the lens surface can be removed by mechanically rubbing the lens with cleaning solutions containing microspheres and other chemical agents. However, repeated cleaning of the lens in this manner may result in physical damage to the lens surface, which damage can be identified microscopically as scratches, depending on the nature of the microspheres or beads utilized in the solutions, for example. Moreover, it is generally either difficult or impossible to remove deposits located beneath the lens surface using prior art cleaning solutions and mechanical rubbing of the lens.

The deposits attached to the lens surface consisting of proteinaceous material can be removed by enzymes; see in this regard U.S. Pat. Nos. 3,910,296 and 4,096,870.

Also, molecular mechanisms for removing cross-linked (denatured) proteins from surfaces with chemical cleaners are described in detail in U.S. Pat. No. 4,311,618. However, nonproteinaceous and proteinaceous materials beneath the lens surface are generally more difficult to remove with enzyme or chemical cleaners.

SUMMARY OF THE INVENTION

It is an object of the present invention to provide compositions and methods for removing protein, lipid and calcium deposits from the surface and subsurface areas of contact lenses.

In order to fulfill the above-stated objective as well as other general objectives of the present invention, there are provided aqueous contact lens cleaning compositions comprising a mixture which includes anionic surfactants of formula:

$$R—O—(CH_2—CH_2—O)_z—CH_2—COOH$$

in which R is a $C_8$ to $C_{18}$ hydrocarbon chain and z is a whole number from 1 to 25. The compositions of the present invention optionally further comprise a chelating agent, urea, and a source of hydrated protons. Methods of cleaning contact lenses using these compositions are also provided.

DETAILED DESCRIPTION OF THE INVENTION

As discussed above, the formation of deposits on human worn soft contact lenses is a well known problem. The formation of such deposits is greatly dependent on the individual patient. These deposits are generally formed after an extended wearing period, but may be formed after only a relatively short period such as one day or less. In general, the material which deposits on soft contact lenses originates from the tear fluid, and consists of insoluble proteinaceous material, lipids, and calcium. Calcium may be deposited as inorganic calcium salts, or as calcium-lipid and calcium-protein complexes.

The exact composition of the material which is deposited also varies from patient to patient. For example, the lenses of some patients may contain primarily calcium deposits, while lenses of other patients may include a preponderance of proteinaceous material. Due to the high water content of soft contact lenses, the material is not only deposited on the lens surface, but also below the lens surface, thereby creating cavities in the polymeric hydrogels. Such material is generally difficult to remove with either the mechanical/chemical or enzymatic treatment methods of the prior art.

This invention relates to nontoxic, aqueous lens cleaning compositions containing an anionic surfactant which has been found to be particularly effective in removing deposits from contact lenses. The compositions of the present invention may also contain a chelating agent, urea, and a source of hydrated protons. The anionic surfactants utilized in the present invention are weakly anionic dissociating compounds of formula:

$$R—O—(CH_2—CH_2—O)_z—CH_2—COOH$$

in which z is a whole number from 1 to 25, preferably 10, 13, or 16, and R is a $C_8$ to $C_{18}$ hydrocarbon chain, preferably a $C_{12}$ hydrocarbon chain.

The above-described surfactants are commercially available. For example, these surfactants are commercially available under the name "AKYPO (RLM)" from CHEM-Y, Emmerich, West Germany. The physical properties and other characteristics of these anionic surfactants are further described in European patent application No. 83201182. g. A preferred anionic surfactant of the above-described type is AKYPO RLM 100.

The amount of surfactant contained in the lens cleaning compositions is typically in the range of from about 0.001% to about 1% (w/v). Certain embodiments of the present invention are specially adapted to clean the lens while it is being worn. In these embodiments, the amount of anionic surfactant utilized will normally be less than the amount utilized in embodiments which are not intended for use in the eye. More particularly, the amount of anionic surfactant utilized in these "in the eye" embodiments of the present invention may be as little as 0.001% (w/v), preferably about 0.01% (w/v).

The commercially available surfactants normally contain impurities which can be removed using conventional techniques, such as ion exchange chromatography.

The calcium chelating agents which may be contained in the compositions of the present invention must be capable of sequestering calcium in a manner such that calcium deposits are effectively removed from the lenses undergoing treatment. Such chelating agents are generally inorganic or organic acids, such as polycarboxylic acids. Chelating agents of this type are described in *Special Publication No.* 17: "Stability Constants of Metal-Ion Complexes," The Chemical Society (London, 1964); the entire contents of this reference relating to the physical properties and other characteristics of such calcium chelating agents are incorporated herein by reference. The preferred chelating agents are polycarboxylic acids, particularly citric acid and ethylenediaminetetraacetic acid (EDTA), and pharmaceutically acceptable salts thereof (e.g., edetate disodium). The amount of chelating agent contained in the lens cleaning solutions is typically from about 0.005% to 0.5% (w/v), preferably from about 0.05% to 0.2%.

Urea and hydrated protons are also optional ingredients in the lens cleaning compositions of the present invention. Urea has been found to be effective in removing both surface and sub-surface deposits of lipids and proteins when utilized in relatively high concentrations, such as 10% w/v or greater. Conversely, it has also been found that urea is somewhat less effective in removing these deposits when utilized in relatively low concentrations. Accordingly, the optional inclusion of this compound in the present solutions will normally be determined by factors such as the severity of the lens deposits and whether the lens are being cleaned in vitro or directly in the eye. If included, the amount of urea contained in the lens cleaning solutions is typically from 0.02% to 1% (w/v), preferably from about 0.2% to 0.6%.

While applicant does not wish to be bound to any particular theory, it is believed that urea changes the molecular conformation of the protein deposits to a less folded aminoacid polymer and converts deposited lipid into a more water soluble clathrate; the surfactants are believed to emulsify the unfolded protein and the lipid clathrate; the chelating agents are believed to remove inorganic and organic calcium deposits by means of salt formation; and the hydrated protons are believed to promote the entire cleaning process through protonation of the deposited proteins. (Reference is made to the following articles for a further discussion concerning the formation of clathrates and alteration of water structure in aqueous solutions containing urea: R. Hinnen et al., *European Journal of Biochemistry,* Vol. 50, pages 1–14 (1924); and R. Marschner, *Chemical & Engineering News,* Vol. 6, pages 495–508 (1955).)

The source of hydrated protons comprises one or more inorganic or organic acids capable of providing free hydrogen ions when in solution at acidic pH. It has been found that free hydrogen ions facilitate removal of protein deposits from the lenses. Citric acid and EDTA are preferred as the source of hydrated protons. This preference is based on, inter alia, formulation simplification, since utilizing these acids as the source of hydrated protons enables the chelating agent and source of hydrated proton functions to be performed by a single compound or compounds. However, other acids such as, for example, sodium dihydrogen phosphate or gluconic acid may also be utilized. The acid or acids utilized as the source of hydrated protons are preferably contained in the present solutions in an amount sufficient to render the solutions slightly acidic, e.g., a pH of about 6.5.

According to the present invention nontoxic, aqueous cleaning compositions which contain one or more of the above-described anionic surfactants, and optionally contain a calcium chelating agent, urea, and a source of hydrated protons, are provided. The anionic surfactants and other optional ingredients may be included in the lens cleaning compositions at concentrations of, for example, 1% to 50% (w/v), preferably 1% to 10% (w/v) for the active removal of heavy lens deposits outside of the eye, 0.1% to 10% (w/v), preferably 0.1% to 1% (w/v) for daily cleaning of lenses outside of the eye, and 0.001% to 1% (w/v), preferably 0.01% to 0.4% (w/v) for cleaning lenses while being worn in the eye. A convenient feature of the present invention is the fact that the compositions may be provided in a concentrated form which can be easily diluted with a suitable diluent (e.g., saline solution or purified water) to adapt the composition to a particular use. It should be noted that these concentrated compositions may contain higher concentrations (w/v%) of the individual component(s) making up the composition than the concentrations described above in connection with each of these components. The compositions of the present invention which are adapted for cleaning contact lenses directly in the eye may be formulated as isotonic or hypotonic solutions.

Typically the lens cleaning compositions of this invention may also include conventional formulatory ingredients, such as preservatives, viscosity enhancing agents, tonicity agents, and buffers. A polymeric germicide known as "POLYQUAD ®" is a preferred preservative. The use of this germicide in contact lens care products is described in U.S. Pat. No. 4,407,791. Sorbic acid, which is also frequently utilized in contact lens care products, represents another preferred preservative. The viscosity enhancing agents which may be employed in the present invention include, for example, hydroxypropyl methylcellulose (HPMC) and dextrans. The tonicity agents, if employed, will typically comprise sodium chloride, potassium chloride, or a mixture thereof. The buffering agents may comprise, for example, boric acid and sodium borate. The pH of the compositions may be adjusted using sodium hydroxide and hydrochloric acid; the present compositions preferably have a pH in the range of from about 6.5 to about 7.8. The selection of particular formulatory ingredients and the inclusion of these ingredients in the present compositions are well within the abilities of a person skilled in the art of contact lens care products.

The present invention also provides methods of cleaning contact lenses. These methods comprise contacting the lenses with the lens cleaning compositions of the present invention. A preferred method of cleaning lenses outside of the eye comprises placing the lenses in a suitable container with an amount of a cleaning composition sufficient to cover the lenses, and then soaking the lenses at room temperature for a period of about 5 minutes to 24 hours, preferably 1 to 12 hours, or for shorter periods at elevated temperatures, e.g., 0.5 to 6 hours at 37° C. A preferred method of cleaning lenses while in the eye comprises applying one to two drops of a diluted cleaning solution to the lenses three or four times per day or as needed to effect cleaning of the lenses.

The following examples further illustrate the present invention, but should not be interpreted as limiting the scope of the invention in any way.

EXAMPLE 1

The following formulations further illustrate the contact lens cleaning compositions of the present invention. All percentages are expressed as weight/volume percent.

| Ingredient | Concentration | | |
|---|---|---|---|
| | Composition A | Composition B | Composition C |
| Anionic Surfactant (RLM-100) | 0.01 | 0.2 | 0.4 |
| Edetate Disodium | 0.01 | 0.05 | 0.05 |
| Citric Acid | — | 0.05 | 0.05 |
| HPMC-2910 | 0.3 | 0.3 | 0.3 |
| Dextran T 75/70 | 0.1 | 0.1 | 0.1 |
| Boric Acid | 0.2 | 0.2 | 0.2 |
| Sodium Borate (Decahydrate) | 0.06 | 0.06 | 0.06 |
| Sodium Chloride | 0.66 | 0.6 | 0.3 |
| Potassium Chloride | 0.1 | 0.1 | 0.1 |
| POLYQUAD ® | 0.001* | 0.001* | 0.001* |
| NaOH and/or HCl | Adjust to pH 7.0 | Adjust to pH 7.0 | Adjust to pH 7.0 |
| Purified Water | QS 100 mL | QS 100 mL | QS 100 mL |

*Plus a 10% excess.

The above compositions may be prepared as follows. The RLM-100, edetate disodium, citric acid (Compositions B and C only), boric acid, sodium borate (decahydrate), dextran T 75/70, sodium chloride, potassium chloride and POLYQUAD® are sequentially dissolved in a portion of the purified water. The pH of the resulting solution is adjusted to 7.0 with 0.1N sodium hydroxide or 0.1N hydrochloric acid. The solution is then sterilized by pressurized filtration through a millipore filtration assembly utilizing a 0.2 micron filter and combined with a sterile, aqueous gel containing the HPMC dispersed therein.

The function of the ingredients in the above-illustrated formulations is as follows. The RLM-100 acts as a cleaning agent. The edetate disodium acts as a cleaning agent via calcium chelation, and also acts as a preservative. The boric acid and sodium borate act as buffering agents; the HPMC-2910 acts as a lubricity/viscosity agent and the dextran acts as a wetting agent; the sodium chloride and potassium chloride act as osmolality adjusting agents; the POLYQUAD® acts as a preservative; and the sodium hydroxide and hydrochloric acid acts as pH adjusting agents.

EXAMPLE 2

Ten heavily deposited, soft contact lenses which had been worn for an extended period were soaked at 37° C. for two hours in an aqueous isotonic solution containing 10% (w/v) urea, 10% (w/v) AKYPO RLM 100, 2.5% (w/v) ethylenediaminetetraacetic acid and 2.5% (w/v) citric acid, which solution had its pH adjusted to 6.4 with NaOH. After soaking, the lenses were equilibrated against saline. The deposits were completely removed, as shown by microscopic examination.

EXAMPLE 3

Five heavily deposited soft contact lenses were treated first with a proteolytic enzyme cleaner. After this treatment, four of these lenses still contained deposits which had not been removed by the proteolytic enzyme. These four lenses were then subjected to the treatment described in Example 2. Microscopic examination subsequent to this treatment revealed that the enzyme resistant deposits had been removed.

What is claimed is:

1. A method of cleaning a contact lens which comprises applying to the contact lens an aqueous contact lens cleaning composition which comprises an effective amount of an anionic surfactant of formula:

$$R—O—(CH_2—CH_2—O)_z—CH_2—COOH$$

in which R is a $C_8$ to $C_{18}$ hydrocarbon chain and z is a whole number from 1 to 25.

2. A method according to claim 1, wherein R is a $C_{12}$ hydrocarbon chain and z is 10.

* * * * *